US008776311B2

(12) United States Patent
Genn et al.

(10) Patent No.: US 8,776,311 B2
(45) Date of Patent: Jul. 15, 2014

(54) CLEANER HEAD FOR A VACUUM CLEANER

(71) Applicant: Dyson Technology Limited, Wiltshire (GB)

(72) Inventors: Stuart Lloyd Genn, Malmesbury (GB); Christopher Lesniowski, Malmesbury (GB); Stephen Benjamin Courtney, Malmesbury (GB)

(73) Assignee: Dyson Technology Limited, Malmesbury, Wiltshire (DE)

( * ) Notice: Subject to any disclaimer, the term of this patent is extended or adjusted under 35 U.S.C. 154(b) by 0 days.

(21) Appl. No.: 13/738,488

(22) Filed: Jan. 10, 2013

(65) Prior Publication Data

US 2013/0174373 A1 Jul. 11, 2013

(30) Foreign Application Priority Data

Jan. 10, 2012 (GB) ..... 1200348.9

(51) Int. Cl.
*A47L 9/04* (2006.01)

(52) U.S. Cl.
USPC ..... 15/377; 15/391; 15/392

(58) Field of Classification Search
USPC ..... 15/377, 391, 392
IPC ..... A47L 5/00,9/04
See application file for complete search history.

(56) References Cited

U.S. PATENT DOCUMENTS

| | | | |
|---|---|---|---|
| 1,638,797 | A | 8/1927 | Claus |
| 1,914,834 | A | 6/1933 | Otto |
| 5,465,451 | A | 11/1995 | Stegens |
| 6,134,745 | A | 10/2000 | Woerwag |
| 6,323,570 | B1 | 11/2001 | Nishimura et al. |
| 2005/0160555 | A1 | 7/2005 | Mayes |
| 2011/0303239 | A1 | 12/2011 | Harrison et al. |
| 2013/0205539 | A1 | 8/2013 | Dyson et al. |
| 2013/0212832 | A1 | 8/2013 | Genn et al. |

FOREIGN PATENT DOCUMENTS

| | | |
|---|---|---|
| DE | 197 06 239 | 4/1998 |
| DE | 198 05 900 | 7/1999 |
| EP | 1 371 317 | 12/2003 |
| GB | 2478386 | 9/2011 |
| JP | 11-42184 | 2/1999 |
| JP | 2000-245662 | 9/2000 |
| JP | 2010-131456 | 6/2010 |

OTHER PUBLICATIONS

Search Report dated Apr. 25, 2012, directed towards GB Application No. 1200348.9; 1 page.

International Search Report and Written Opinion dated Mar. 26, 2013, directed to International Application No. PCT/GB2012/053229; 8 pages.

Genn et al., U.S Office Action mailed Oct. 2, 2013, directed to U.S Appl. No. 13/761,990; 5 pages.

*Primary Examiner* — David Redding
(74) *Attorney, Agent, or Firm* — Morrison & Foerster LLP

(57) ABSTRACT

A cleaner head for a vacuum cleaner houses a hollow brush bar mounted for rotation about an axis. This brush bar is driven by a motor housed inside the hollow brush bar, the motor forming part of a drive assembly supported at one end of the cleaner head. The brush bar is arranged for removal from the cleaner head by sliding the brush bar along the axis and out through an opening at the opposite end of the cleaner head and the brush bar is rotatably supported in clearance around the drive assembly by a first bearing, which bearing engages the brush bar in a corresponding axial-sliding fit to allow said sliding removal of the brush bar.

15 Claims, 5 Drawing Sheets

CLEANER HEAD FOR A VACUUM CLEANER

REFERENCE TO RELATED APPLICATIONS

This application claims the priority of United Kingdom Application No. 1200348.9, filed Jan. 10, 2012, the entire contents of which are incorporated herein by reference.

FIELD OF THE INVENTION

The present invention relates to the field of vacuum cleaners, and in particular to a cleaner head for a vacuum cleaner.

BACKGROUND OF THE INVENTION

The invention is concerned specifically with cleaner heads which incorporate a motor-driven agitator. The vacuum cleaner, on the other hand, may be of any general type. For example, the cleaner head may be a fixed cleaner head on an upright vacuum cleaner, or alternatively it may be the cleaner head of a floor tool used with a cylinder vacuum cleaner or stick-vac cleaner.

It is conventional to provide the cleaner head of a vacuum cleaner with an agitator, such as a rotating brush bar, for agitating or "beating" a floor surface—particularly carpet—to improve pick-up performance.

Although the main vac-motor on the cleaner can be used to drive this agitator, it is more common to use a separate, dedicated motor to drive the agitator. This separate motor can then be positioned close to the agitator—usually somewhere on the cleaner head itself—to simplify the transmission arrangement. In a particularly space-efficient arrangement described in U.S. Pat. No. 1,914,834—FIG. 1 of which has been reproduced here—the cleaner head a has an agitator in the form of a hollow tubular brush bar d rotatably mounted on an axle b. This brush bar d effectively constitutes a rotor which is driven by an armature c housed inside the brush bar d.

It is preferable that the agitator in a cleaner head is separately removable for cleaning, repair or replacement. However, in the arrangement in U.S. Pat. No. 1,914,834 this is made impossible because the armature c prevents separate removal of the brush bar d.

SUMMARY OF THE INVENTION

According to the present invention, there is provided: a cleaner head for a vacuum cleaner, the cleaner head housing a hollow brush-bar mounted for rotation about an axis, the brush-bar being driven by a motor housed inside the hollow brush-bar, the motor forming part of a drive assembly supported at one end of the cleaner head, the brush-bar being arranged for removal from the cleaner head by sliding the brush-bar along the axis and out through an opening at the opposite end of the cleaner head, wherein the brush bar is rotatably supported on said drive assembly via a bearing, which bearing engages the brush bar in a corresponding axial-sliding fit to allow said sliding removal of the brush bar.

The brush bar is straightforwardly and conveniently removed by sliding the brush bar out through an opening at the opposite end of the cleaner head to the drive assembly end. There is no need to provide any complicated hinging mechanisms to allow for removal of the brush bar. Instead, the drive assembly can be fixedly mounted in the cleaner head.

In use, the bearing helps maintain a stable clearance between the brush-bar and the drive assembly. Nevertheless, because the brush-bar engages the bearing in an axial-sliding fit, straightforward axial sliding removal of the brush bar is not inhibited by this bearing.

The brush-bar may engage the bearing in a friction-fit. This is considered particularly convenient, but it is not essential. For example, the brush-bar may axially engage the bearing via some sort of splined-fit.

The bearing may be soft-mounted on the drive-assembly. For example, a resilient member—such as an elastomeric mounting collar or ring—may be provided between the inner race and the drive assembly. Similarly, the brush bar may be soft-mounted on the bearing. For example, a resilient member—such as an elastomeric mounting collar or ring—may be provided between the bearing outer race and the brush bar. Preferably, a resilient member is provided between both the inner race and the drive assembly, and the outer race and the brush bar. This helps reduce vibrations transmitted to the brush bar through the drive assembly.

The drive assembly may engage the brush bar via a drive dog. This drive dog may also engage the brush-bar in a corresponding axial-fit so as not to inhibit removal of the brush-bar through the opening in the opposite end of the cleaner head. In this sort of arrangement, the use of a soft-mounted bearing is particularly advantageous in taking up assembly tolerances, particularly if the drive-dog is spaced at the opposite end of the cleaner head from the drive assembly. Spacing the drive-dog and bearing towards opposite ends of the cleaner head in this manner provides a stable support for the brush bar.

The brush bar may be 'indirect-drive'—being driven via some sort of transmission—or 'direct-drive'. In an indirect-drive arrangement, the transmission may be an epicyclic gearing arrangement, but this is not essential. The transmission may form part of the drive assembly supported at one end of the cleaner head, but again this is not essential—for example a gearbox could be located at the opposite end of the cleaner head from the motor, so that the motor and gearbox counterbalance one another.

A removable end cap may be provided at the end of the cleaner head opposite the drive assembly, to allow said sliding removal of the brush bar. The brush bar may be supported in use by a second bearing which is provided in this end cap. This second bearing may conveniently engage the brush bar in a straightforward push-fit, allowing easy disengagement of the end cap from the brush bar, for example to allow convenient replacement of the brush bar. The end cap may be secured to the relevant end of the cleaner head by a bayonet fitting, but this is not essential.

BRIEF DESCRIPTION OF THE DRAWINGS

Embodiments of the invention will now be described by way of example with reference to the accompanying drawings, in which.

DETAILED DESCRIPTION OF THE INVENTION

Figure 1:
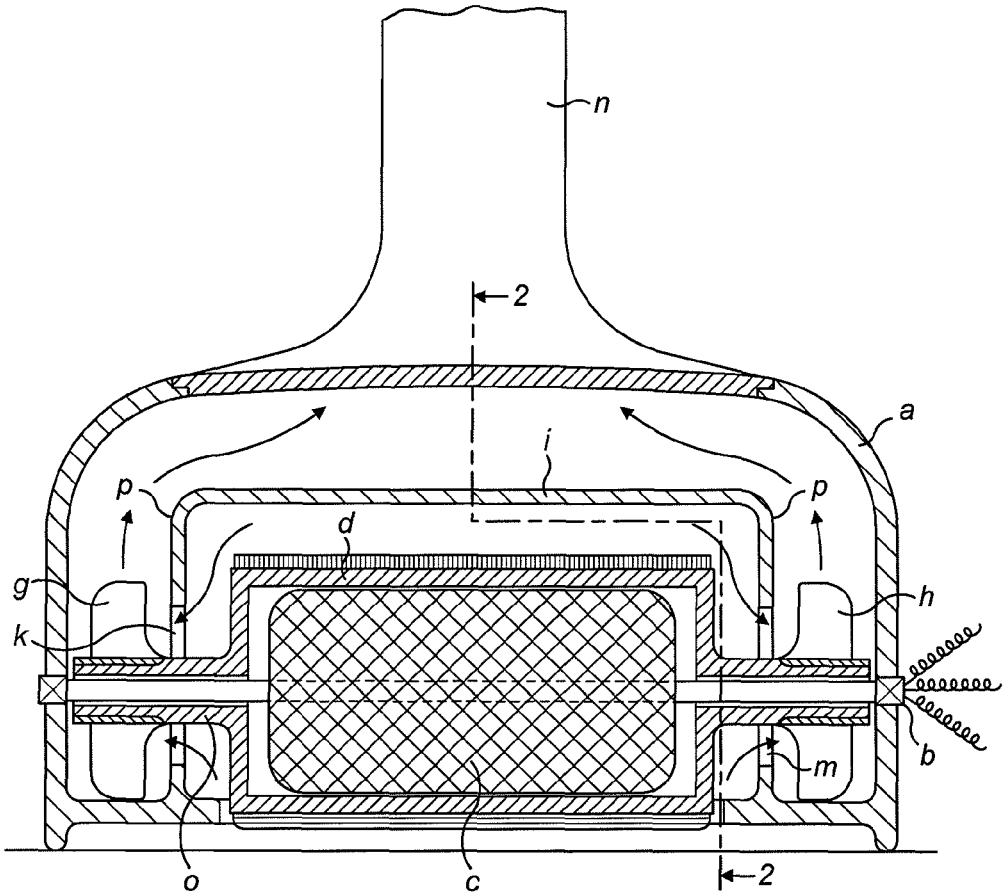
FIG. 1 Prior Art
FIG. 1 is a front-on sectional view of a conventional cleaner head.
Figure 2:
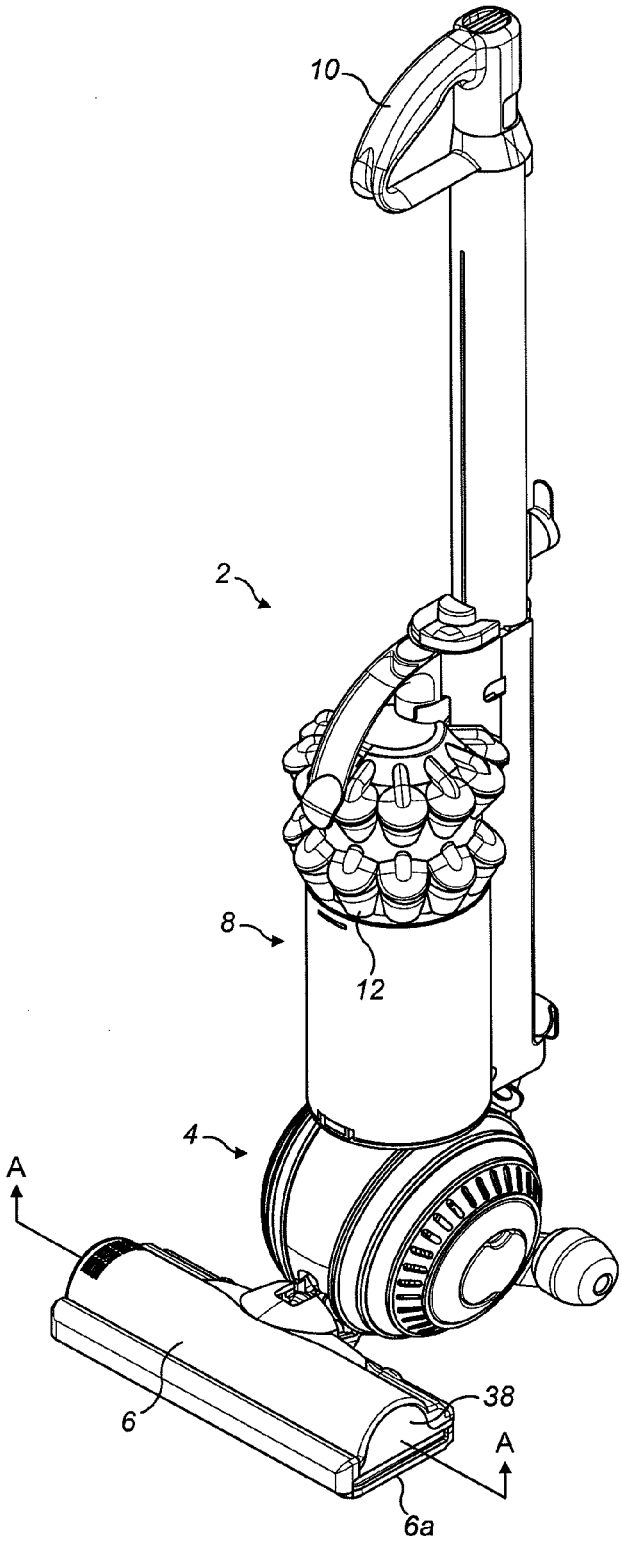
FIG. 2 is a perspective view of a vacuum cleaner incorporating a cleaner head according to the present invention.

FIG. 2 shows an upright vacuum cleaner 2. The cleaner 2 has a rolling head assembly 4 which carries a fixed cleaner head 6, and an 'upright' body 8 which can be reclined relative to the head assembly 4 and which includes a handle 10 for manouevring the cleaner 2 across the floor. In use, a user grasps the handle 10 and reclines the upright body 8 until the handle 10 is disposed at a convenient height for the user; the user can then roll the vacuum cleaner 2 across the floor using the handle 10 in order to pick up dust and other debris on the floor. The dust and debris is drawn in through a downward-facing suction opening—which opening is provided in a soleplate 6*a* on the underside of the cleaner head 6—by a motor-driven fan housed on-board the cleaner 2. From here, the dirt-laden air stream is ducted in conventional manner under the fan-generated suction pressure to a cyclonic separating apparatus 12, where dirt is separated from the air before the relatively clean air is then exhausted back to the atmosphere.

The soleplate 6*a* is removable in conventional manner to provide access to the inside of the cleaner head 6.

Figure 3:
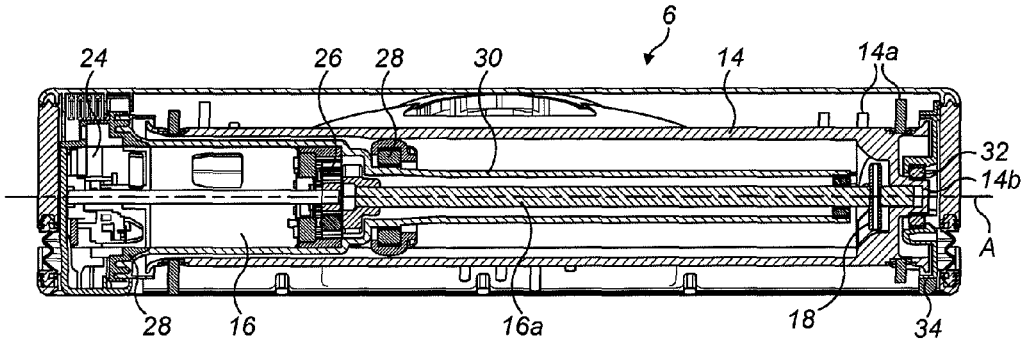
FIG. 3 is a sectional view of the cleaner head in FIG. 2, viewed from the underside of the cleaner head.

The cleaner head 6 is shown in more detail in FIG. 3 which is a section along A-A in FIG. 2. It comprises a hollow, cylindrical brush-bar 14 which is mounted inside the cleaner head 6 for rotation about an axis A. The brush bar 14 is aimed primarily at improving "pick up" on carpeted surfaces. In use, the bristles 14*a* on the brush bar 14 reach through the suction opening in the soleplate 6*a* to penetrate the carpet fibres, and the agitating action of the brush bar 14 as it rotates helps dislodge stubborn dirt clinging to the carpet fibres so that this dirt can then be more easily entrained in the airflow drawn into the cleaner head 6 through the suction opening.

Figure 4:
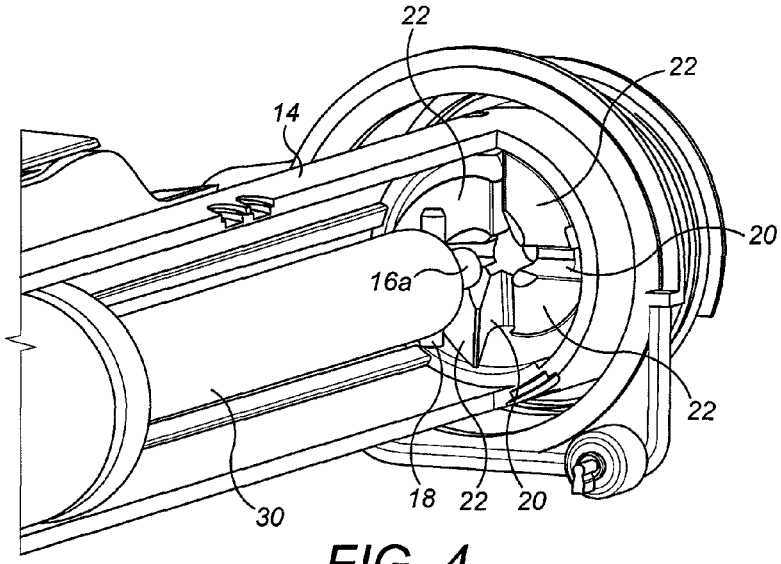
FIG. 4 is a three-quarter cutaway view illustrating engagement of a drive dog with the brush bar.

The rotating brush bar 14 is driven by a dedicated brush bar motor 16, which is housed co-axially inside one end of the hollow brush bar 14. The motor 16 drives the brush bar 14 via a drive dog 18 on the output shaft 16*a* which keys into the opposite end of the brush bar 14, from the inside. The drive dog 18 engages the brush bar 14 axially—parallel to the rotation axis A—and is guided into engagement with one of two alternative keyways 20 on the brush bar 14 by respective cam surfaces 22 (FIG. 4).

The motor 16 forms part of a larger drive assembly 24, which is cantilevered at one end of the cleaner head 6. This drive assembly 24 includes an epicyclic gearbox 26 at the inboard end of the motor 16, and a mounting bracket 28 at the outboard end of the motor 16 which provides cantilever support for the motor 16 and gearbox assembly 26 inside the brush bar 14.

The brush bar 14 fits over the drive assembly 24 like a sleeve and is rotatably supported on the drive assembly 24 via a first bearing 28, which holds the brush bar 14 in clearance around the drive assembly 24. The first bearing 28 is positioned in this case immediately in-board of the gearbox 26, on a protective housing 30 which helps prevent ingress of dust to the motor 16 and gearbox 26.

The brush bar 14 engages the first bearing 28 in an axial-sliding friction fit, allowing the brush bar 14 to slide axially over the drive assembly 24 like a sleeve.

Figure 5A:
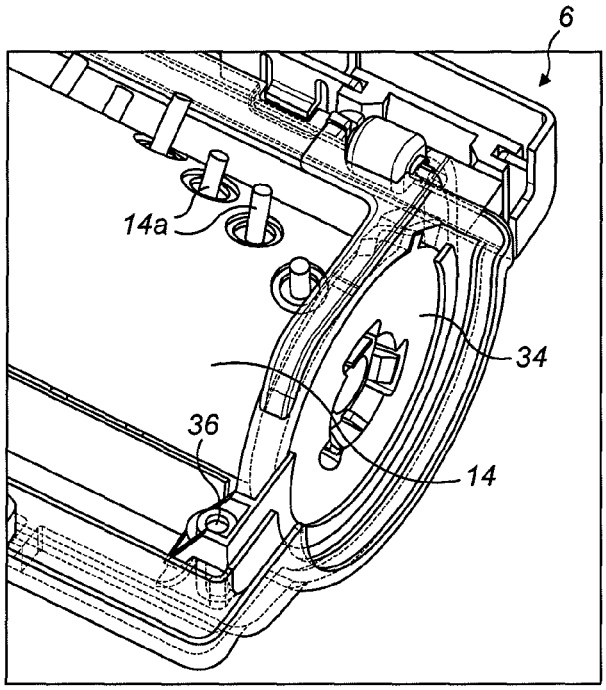
FIGS. 5*a* and 5*b* are perspective cutaway views illustrating operation of a removable end cap which is provided at one end of the cleaner head housing to allow removal of the brush bar through that end of the housing.
Figure 5B:
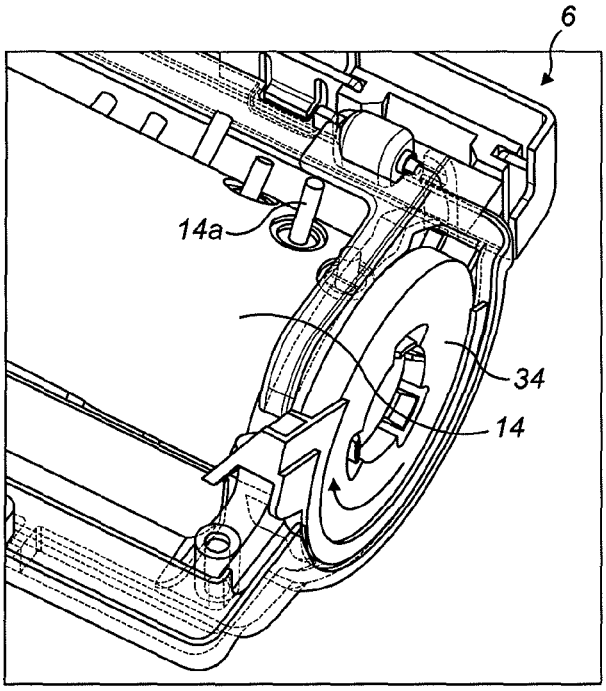

A second bearing 32 supports the opposite end of the brush bar 14. This second bearing 32 is provided in a removable end cap 34. The second bearing 32 push-fits axially onto the mating end 14*b* of the brush bar 14. An axial push-fit is not essential—but it is simple and effective. The end cap 34 itself is secured to the housing via a bayonet-style fitting. This is best shown in FIGS. 5*a* and 5*b*, here with the soleplate 6*a* removed. Again, the use of a bayonet-style fitting is simple and effective, but not essential. In this case, the end cap 34 is locked in place by a screw 36 to prevent accidental release, but this is optional.

The removable soleplate 6*a* incorporates an end cover—similar to the end cover 38 shown at the opposite end of the cleaner head 6 in FIG. 2—which fits over the end cap 34 when the soleplate 6*a* is in place, preventing access to the end cap 34 in use and providing a 'clean' finished appearance to the end of the cleaner head 6.

Figure 6:
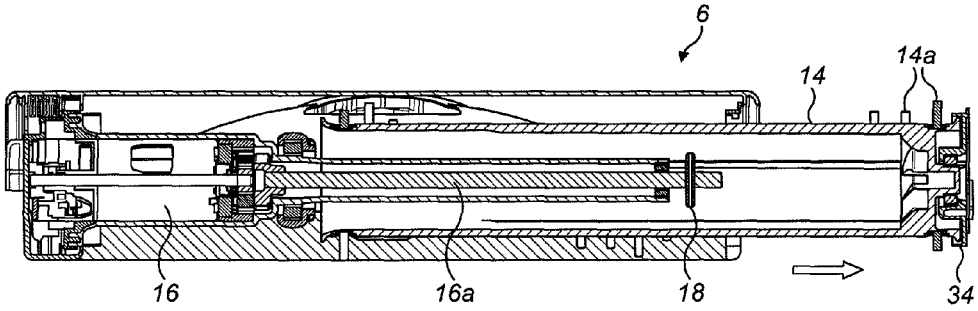
FIG. 6 is a sectional view of the cleaner head corresponding to FIG. 3, but illustrating sliding removal of the brush bar.

Occasionally, the brush bar 14 will require removal for cleaning, repair or replacement. To remove the brush bar 14, the user first removes the soleplate and then releases the end cap 34 and slides the brush bar 14 axially (parallel with the rotation axis A) out through the open end of the cleaner head 6, as shown in FIG. 6. The end cap 34 may be removed from the brush bar 14—and ultimately will need to be if the brush bar 14 is being replaced entirely—or, alternatively, the end cap 34 and brush bar 14 may be pulled out together as one piece.

The axial sliding fit between the first bearing 28 and the brush bar 14 means that axial sliding removal of the brush bar 14 is not inhibited by the first bearing 28. Thus, the brush bar 14 can simply be axially withdrawn from around the motor 16 like a sleeve, and the whole drive assembly 24 can remain securely fixed at the closed end of the cleaner head 6. There is no requirement for any complex hinged mounting of the motor or larger drive assembly.

Similarly, because the drive dog 18 keys axially into the brush bar 14 from the inside, the drive dog 18 likewise does not hinder axial sliding removal of the brush bar out through the end of the cleaner head 6. This is preferable to an arrangement in which the drive dog engages the brush bar radially—although such arrangements may alternatively be used—because a radial interlock between the drive dog and brush bar tends to inhibit axial removal of the brush bar, unless some sort of auto-release mechanism is provided.

Following cleaning, repair, or replacement, the brush bar 14 is (re-)inserted back in through the open end of the cleaner head 6 and is brought into frictional engagement with the first bearing 28 and into axial keying engagement with the drive dog 18 (via the cam surfaces 22). Again, the brush bar 14 simply slides over the drive assembly 24 like a sleeve, which does not therefore hinder insertion of the brush bar 14. Once the brush bar 14 has been fully inserted, the end cap 34 can then be secured to the housing via the bayonet fitting to hold the brush bar in place (it will be necessary to push-fit the end cap 34 back onto the brush bar if it has previously been removed from the end of the brush bar 14, in which case this is best done before the brush bar 14 is inserted into the cleaner head 6). Once the soleplate 6*a* has been put back in place, the cleaner head 6 is then ready for use again.

Figure 7:
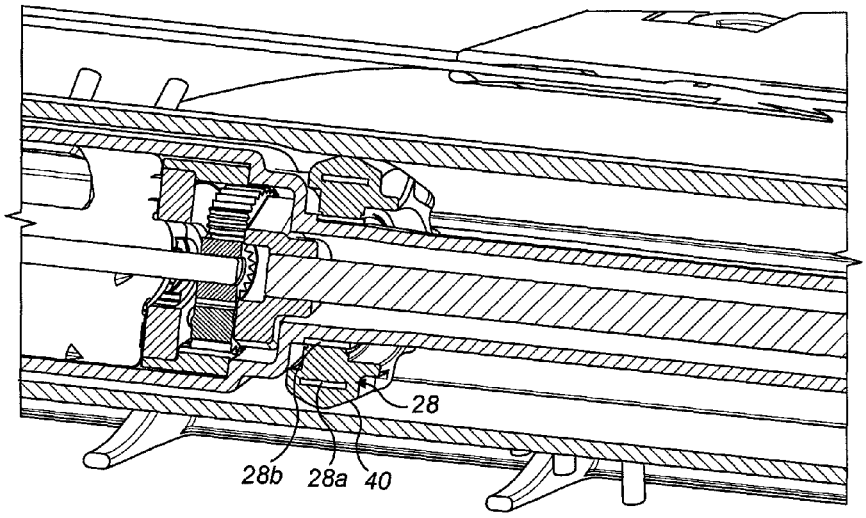
FIG. 7 is a three-quarter cutaway view, illustrating soft-mounting of the brush bar on the drive assembly.

The brush bar 14 is soft-mounted on the outer race 28*a* of the bearing 28 via an elastomeric mounting collar 40 (FIG. 7), which may be over-moulded onto the outer race 28*a*. This provides a degree of radial compliance between the brush bar 14 and the drive assembly 24, which helps take up assembly tolerances. This soft-mounting also provides effective vibration damping for the brush bar in use. The inner race 28*b* of the bearing 28 may be likewise soft-mounted on the drive assembly 24.

The first bearing 28 need not be mounted on the drive assembly 24, nor is it essential that the first bearing 28 is provided on the inside of the brush bar 14: a first bearing could equally be arranged to engage the outer surface of the brush bar 14 in an axial-sliding fit.

The invention claimed is:

1. A cleaner head for a vacuum cleaner, the cleaner head housing a hollow brush bar mounted for rotation about an axis, the brush bar being driven by a motor housed inside the hollow brush bar, the motor forming part of a drive assembly fixedly mounted at one end of the cleaner head, the brush bar being arranged to fit around the motor like a sleeve thereby allowing the brush bar to be removed from the cleaner head by sliding the brush bar along the axis and out through an opening at the opposite end of the cleaner head, wherein the brush bar is rotatably supported in clearance around the drive assembly by a first bearing, which bearing engages the brush bar in a corresponding axial-sliding fit so as not to inhibit said sliding removal of the brush bar.

2. The cleaner head of claim 1, wherein the motor drives the brush bar via a drive dog and this drive dog engages the brush bar in a corresponding axial sliding fit so as not to inhibit said sliding removal of the brush bar.

3. The cleaner head of claim 2, wherein the drive dog engages the brush bar at the end opposite the drive assembly.

4. The cleaner head of claim 1, wherein the first bearing is supported on the drive assembly.

5. The cleaner head of claim 1, wherein the first bearing and brush bar engage one another in a splined fit.

6. The cleaner head of claim 1 wherein the first bearing engages the brush bar in a friction fit.

7. The cleaner head of claim 1, wherein the inner race of the first bearing is soft-mounted to the drive assembly to provide a degree of radial compliance between the inner race and the drive assembly.

8. The cleaner head of claim 1, wherein the brush bar is soft-mounted to the outer race of the bearing to provide a degree of radial compliance between the outer race and the brush bar.

9. The cleaner head of claim 7 or claim 8, wherein the soft-mounting is provided by an elastomeric member.

10. The cleaner head of claim 1, wherein a removable end cap is provided at the end of the cleaner head opposite the drive assembly, to allow said sliding removal of the brush bar.

11. The cleaner head of claim 10, wherein the brush bar is additionally supported in use by a second bearing provided in the end cap.

12. The cleaner head of claim 11, wherein the second bearing engages the brush bar in an axial-sliding push-fit.

13. The cleaner head of claim 10, wherein the end cap is secured to the housing via a bayonet-style fitting.

14. A cleaner head for a vacuum cleaner, the cleaner head housing a hollow brush bar mounted for rotation about an axis, the brush bar being driven by a motor housed inside the hollow brush bar, the motor forming part of a drive assembly supported at one end of the cleaner head, the brush bar being arranged to fit around the motor like a sleeve thereby allowing the brush bar to be removed from the cleaner head by sliding the brush bar along the axis and out through an opening at the opposite end of the cleaner head, wherein the brush bar is rotatably supported in clearance around the drive assembly by a first bearing, which bearing engages the brush bar in a corresponding axial-sliding fit so as not to inhibit said sliding removal of the brush bar, wherein a removable end cap is provided at the end of the cleaner head opposite the drive assembly, to allow said sliding removal of the brush bar, and wherein the brush bar is additionally supported in use by a second bearing provided in the end cap.

15. The cleaner head of claim 14, wherein the second bearing engages the brush bar in an axial-sliding push-fit.

* * * * *